US005141169A

United States Patent [19]

Sugioka

[11] Patent Number: 5,141,169

[45] Date of Patent: Aug. 25, 1992

[54] METHOD AND APPARATUS FOR WINDING A YARN ACCORDING TO DESIRED TENSION AND WINDING SPEED

[75] Inventor: Takami Sugioka, Matsuyama, Japan

[73] Assignee: Teijin Seiki Co., Ltd., Osaka, Japan

[21] Appl. No.: 561,713

[22] Filed: Aug. 1, 1990

[51] Int. Cl.[5] ..... B65H 54/00; B65H 59/38

[52] U.S. Cl. ..... 242/18 R

[58] Field of Search ..... 242/18 DD, 18 R, 36, 242/45

[56] References Cited

U.S. PATENT DOCUMENTS

| | | | |
|---|---|---|---|
| 4,245,794 | 1/1981 | Hasegawa et al. | 242/45 |
| 4,307,848 | 12/1981 | Barathieu | 242/18 R |
| 4,394,986 | 7/1983 | Hasegawa et al. | 242/18 R |
| 4,494,702 | 1/1985 | Miyake et al. | 242/18 R |
| 4,685,629 | 8/1987 | Sugioka | 242/18 R |
| 4,715,548 | 12/1987 | Miyake et al. | 242/18 R |
| 4,830,296 | 5/1989 | Ueda et al. | 242/18 R |
| 4,964,582 | 10/1990 | Hermanns et al. | 242/18 R X |

FOREIGN PATENT DOCUMENTS

| | | | |
|---|---|---|---|
| 0492045 | 2/1974 | Japan . | |
| 0021572 | 1/1977 | Japan | 242/45 |
| 0591980 | 2/1979 | Japan | 242/45 |
| 55-25583 | 7/1980 | Japan . | |
| 58-42362 | 2/1983 | Japan . | |
| 1270063 | 11/1986 | U.S.S.R. | 242/45 |

*Primary Examiner*—Stanley N. Gilreath

*Attorney, Agent, or Firm*—Rothwell, Figg, Ernst & Kurz

[57] ABSTRACT

In a yarn winding apparatus which comprises a bobbin holder for holding a yarn winding bobbin and a contact roller pressed against the bobbin held by the bobbin holder or a package wound onto the bobbin and by which the yarn is continuously wound, the winding apparatus further comprises a rotating speed detector for detecting a rotating speed of the contact roller and a tension detector for detecting a tension in the yarn, and rotation of a motor for driving the bobbin holder is controlled based on information comprising data detected by the rotating speed detector and data detected by the tension detector so that the winding speed is adjusted to a predetermined value.

7 Claims, 7 Drawing Sheets

SETTING DEVICE
15
PERIPHERAL SPEED SETTING DEVICE
29
TENSION SETTING DEVICE
28
PERIPHERAL SPEED DETECTOR
22
TENSION DETECTOR
21
COMPARATOR
27
CALCULATION OF DESIRED VALUE OF PERIPHERAL SPEED
26
COMPARATOR
25
PI CONTROLLER
23
FREQUENCY SETTING DEVICE
24
INVERTER
14
13
7
Y
9
4
3
2
11
12

PI CONTROLLER
23
FREQUENCY SETTING DEVICE
24
INVERTER
14
PERIPHERAL SPEED DETECTOR
22
COMPARATOR
25
PERIPHERAL SPEED SETTING DEVICE
29
CALCULATION OF DESIRED VALUE OF PERIPHERAL SPEED
26
TENSION SETTING DEVICE
28
COMPARATOR
27
TENSION DETECTOR
21
32
33
Y
9
12
11
2
3
4

METHOD AND APPARATUS FOR WINDING A YARN ACCORDING TO DESIRED TENSION AND WINDING SPEED

BACKGROUND OF THE INVENTION

The present invention relates to a method and apparatus for winding a yarn. More specifically, the present invention relates to a method and an apparatus for winding a synthetic yarn by which a yarn can be wound without being broken and by which a stable winding operation can be done.

Conventionally, such methods and apparatus for winding a yarn are roughly classified into the following (a) and (b).

(a) Peripheral speed control type, disclosed in, for example, Japanese Utility model Application Laid-open No. Sho 58-71053 corresponding to U.S. Pat. No. 4,494,702, or Patent Application Laid-open No. Sho 49-20452.

(b) Tension control type, disclosed in, for example, Japanese Patent Publication No. Sho 55-25583.

Further, Japanese Patent Application Laid-open No. 58-42562 discloses a method and an apparatus for winding a yarn of a tension control type wherein the rotating speed of a bobbin holder is detected upon start of rotation of the bobbin holder so that the rotating ratio, i.e., the wind ratio, between the traverse motion and the rotation of the bobbin holder is kept at a predetermined value.

However, in these conventional apparatus, these exist the following problems.

In a yarn winding apparatus of the peripheral speed control type, high shoulders, which are generated between the start of winding operation and the completion of the winding operation, are increased in height as the amount of package increases, while the tension in yarn decreases, and accordingly, the yarn may be broken.

Further, in a winding operation of a yarn for industrial use, finishes applied to the yarn may adhere to the surfaces of a roller for detecting the peripheral speed or a draw roller, and the friction coefficient between the rollers and the yarn may be varied, or the tension in yarn may be changed as the winding operation is done due to the change of degree of polymerization of the yarn per se, and the yarn may be broken when the tension in yarn is excessively decreased.

The above-described phenomena often occur at a high speed winding or a low retraction yarn, and consequently there is a problem that productivity is low.

In a yarn winding apparatus of tension control type, response of the yarn tension detector is poor when a thin yarn, i.e., a yarn having a small denier, is wound since the tension in yarn is low, and accordingly, the apparatus cannot adequately respond to a sudden change of tension in yarn.

As described above, in conventional methods and apparatus for winding yarn, the peripheral speed control system and the tension control system have been independently used but have not been combined together.

Further, the method and apparatus disclosed in the above-described Japanese Patent Application Laid-open No. Sho 58-42562 are basically of the peripheral speed control type, and only during start of rotation of the bobbin holder, the rotating speed of the bobbin holder is detected in order to keep the wind ratio at a predetermined value, and accordingly, the tension control system and the peripheral speed control system are not combined while the yarn is wound.

OBJECTS OF THE INVENTION

Taking the situations described above, it is an object of the present invention to provide a stable winding by controlling a winding apparatus simultaneously utilizing the advantages of both the conventional systems, i.e., systems of a peripheral speed control type and of a tension control type.

When the present invention is applied a winding apparatus of spindle drive type, a bobbin holder for holding yarn winding bobbin is driven by a motor, and a contact roller is pressed against the bobbin inserted onto the bobbin holder or to a package wound on the bobbin.

Further, when the present invention is applied a winding apparatus of a friction drive type, the winding apparatus comprises a bobbin holder for holding a yarn winding bobbin and a contact roller pressed to the bobbin inserted onto the bobbin holder or to a package wound onto the bobbin, and the contact roller is connected to a drive motor.

SUMMARY OF THE INVENTION

According to the method of the present invention, the above-described object is achieved by a method for winding a yarn in a yarn winding apparatus which comprises a bobbin holder for holding a yarn winding bobbin and a contact roller pressed to the bobbin held by the bobbin holder or to a package wound onto the bobbin and by which the yarn is continuously wound, characterized in that the winding apparatus further comprises a rotating speed detector for detecting a rotating speed of the contact roller and a tension detector for detecting a tension in the yarn, and that rotation of a motor for driving the bobbin holder is controlled based on information from both comprising data detected by the rotating speed detector and data detected by the tension detector so that the winding speed is adjusted to a predetermined value.

In order to achieve the above-described object, a yarn winding apparatus according to the present invention comprises a bobbin holder for holding a yarn winding bobbin and a contact roller pressed to the bobbin held by the bobbin holder or to a package wound onto the bobbin and by which the yarn is continuously wound, characterized in that the winding apparatus further comprises:

a rotating speed detector for detecting a rotating speed of the contact roller;

a tension detector for detecting a tension in the yarn; and a control means for controlling rotation of a motor for driving the bobbin holder, by which value detected by the rotating speed detector is controlled at a predetermined and desired value and by which the desired value of the rotating speed of the contact roller is varied based on the tension in yarn detected by the tension detector so that tension detected by the tension detector is controlled to a predetermined value.

According to the method of the present invention, rotation of a motor for driving the bobbin holder is controlled based on information comprising data detected by the rotating speed detector and data detected by the tension detector so that the winding speed is adjusted to a predetermined value, accordingly, a stable winding operation can be performed by controlling a winding apparatus simultaneously utilizing the advantages of both the conventional systems of the peripheral speed control type and the tension control type.

Further, according to the winding apparatus of the present invention, the rotation of the motor which directly or indirectly drives the bobbin holder is controlled so that the rotating speed of the contact roller which is pressed to the package converges to a predetermined and desired value, and at the same time, the tension in the yarn which is being wound is detected and the desired value of the rotating speed of the contact roller is varied so that the tension is controlled to a predetermined value. Accordingly, a sudden change of speed can be overcome in a short time by the control of rotation of the motor, and a tension variation as a function of time or due to increase in width of the wound package can be overcome by varying the desired value of the rotating speed of the contact roller, Therefore, stable winding operation with high control accuracy can be realized.

In addition, in a high speed winding operation transient, tension variation in yarn as a result of the traverse motion may be detected so as to feed back to the winding operation.

BRIEF DESCRIPTION OF THE DRAWINGS

The present invention will now be explained with reference to the accompanying drawings, wherein.

PREFERRED EMBODIMENTS

Figure 1:
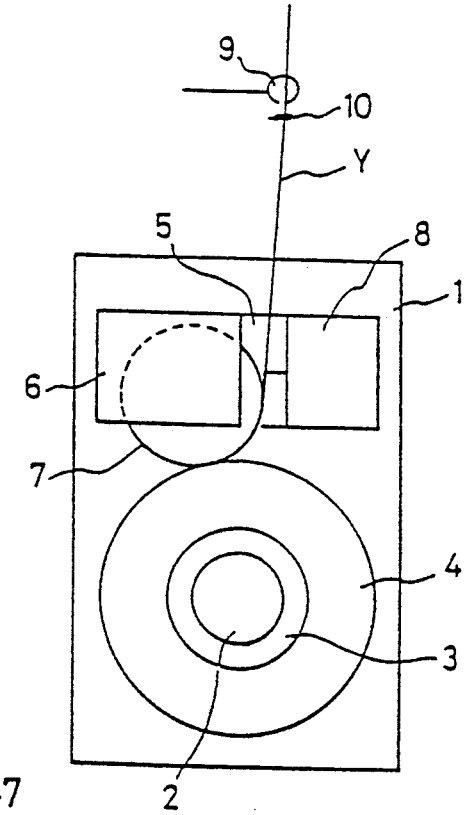
FIG. 1 is an elevation of an embodiment of a winding apparatus according to the present invention.
Figure 2:
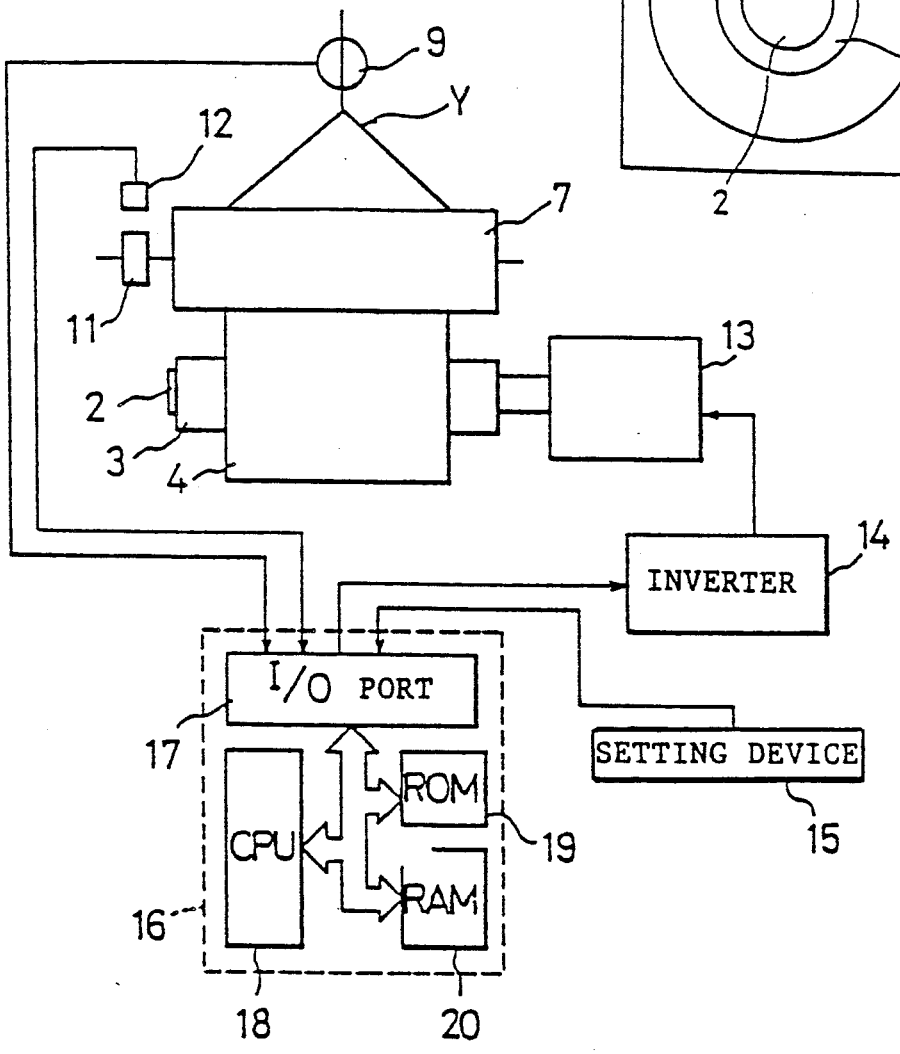
FIG. 2 is a schematic block diagram of a control system of the embodiment of the winding apparatus of a spindle drive type according to the present invention.

FIGS. 1 and 2 show an embodiment of a yarn winding apparatus of a spindle drive type according to the present invention.

The construction will now be explained first. In FIG. 1, which is an elevation, reference numeral 1 denotes a machine frame of the winding apparatus, the machine frame 1 having a bobbin holder 2 which is rotatably projecting therefrom and onto which a bobbin 3 is inserted. The bobbin holder 2 is connected to an electric motor 13 (FIG. 2) and is driven by the electric motor 13.

The machine frame 1 has a slide block 5 which is vertically movable along slide shafts (not shown).

The slide block 5 has a frame 6 and a traverse device 8 projecting therefrom. The frame 6 has a contact roller 7 rotatably mounted thereon, and the traverse device 8 traverses a yarn Y to and fro.

The yarn Y traversed by the traverse device 8 is wound onto the bobbin 3 inserted onto the bobbin holder 2 to form a package 4. The contact roller 7 is pressed to the package 4 and is frictionally driven by the package 4.

As illustrated in FIG. 2, a shaft of the contact roller 7 has a gear 11 fixed thereto, and an electro-magnetic pickup 12 of a conventionally known type is disposed near the gear 11, so that the rotating speed of the contact roller 7 is detected by the rotation of the gear 11.

Referring to FIG. 1 again, a guide 10 which constitutes a fulcrum of traverse motion is disposed above the contact roller 7, and a tension sensor 9 of a conventionally known type is disposed above the guide 10.

In this embodiment, a pressure sensitive sensor is used as the tension sensor 9 however, another known sensor, such as a strain gauge, may be used.

As illustrated in FIG. 2, the bobbin holder 2 is connected to the electric motor 13, i.e., the induction motor, and the motor 13 is connected to an inverter 14.

The output control of the inverter 14 is performed based on the commands from a micro computer 16, and signals from the electro-magnetic pickup 12 and the tension sensor 9 are input to I/O port 17 of the micro computer 16.

The frequency of the inverter 14 is controlled based on the detected signal from the electro-magnetic pickup 12 in order to control, i.e., feed-back control, the rotation of the motor 13 so that the rotating speed of the contact roller 7 during the yarn winding operation becomes a predetermined value.

The tension sensor 9 is disposed on the yarn path above the guide 10 for fulcrum of the traverse motion, and the tension sensor 9 is in contact with the yarn so as to detect tension in yarn which is being wound. Based on the detected tension in yarn, as will be described later, the optimum value of the desired rotating speed of the contact roller 7 is calculated by the micro computer 16.

The micro computer 16 receives the output from the setting device 15. In the setting device 15, the winding speed of the yarn and tension in yarn are set. The micro computer 16 is of a well known type and essentially comprises a central processing unit (CPU) 18, a random access memory (RAM) 20, a read only memory (ROM) 19 and the I/O port 17.

In the ROM 19, a program for controlling CPU 18 is stored. The CPU 18 operates while it reads necessary external data through I/O port 17 or transfers data to and from the RAM 20, and it outputs the processed data to the I/O port 17 when required. The I/O port 17 includes interfaces, such as a D/A converter or an A/D converter, which are necessary to communicate with the exterior.

Figure 3:
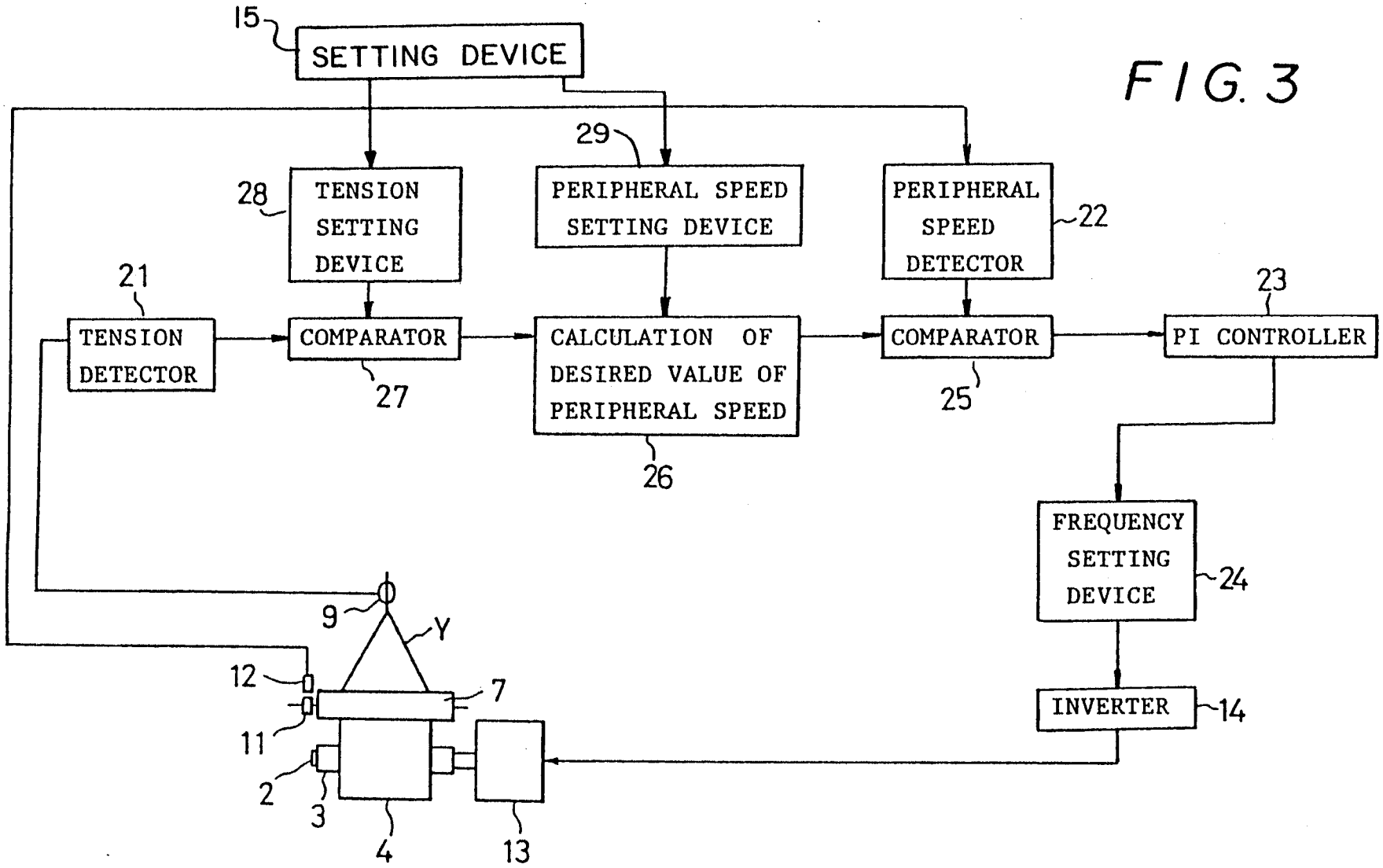
FIG. 3 is a schematic block diagram of a control system of the embodiment of the winding apparatus of a spindle drive type according to the present invention.

In FIG. 3 which shows a block diagram of the above-described embodiment of the present invention, the operation will now be explained. Set value of the setting device 28 of the tension in yarn and set value of the setting device 29 of peripheral speed are set by the setting device 15.

As described above, the bobbin holder 2 is driven by motor 13 which is controlled by the inverter 14, and the contact roller 7 is pressed against the bobbin 3 inserted onto the bobbin holder 2, and thus the package 4 is wound onto the bobbin 3. As described above, the shaft of the contact roller 7 has gear 11 fixed thereto, and the rotating speed of the contact roller 7 is detected by the electro-magnetic pickup 12.

Upon threading of the yarn, the motor 13 which drives the bobbin holder 2 is driven along a predetermined accelerating curve to a predetermined speed which has been set by the peripheral speed setting device 29. On the other hand, pulses generated by the teeth of the gear 11 are sampled by the electro-magnetic pickup 12 and are detected by the peripheral speed detector 22. Based on the value set by the peripheral speed setting device 29, the desired value is calculated by a calculating circuit 26 for the peripheral speed.

The desired value which has been calculated, and the detected value are compared with each other in a comparator 25, and deviation is calculated there. Based on the deviation thus obtained, a controller 23 performs PI control, i.e., proportional and integral control, and the frequency of the inverter 14 is set by the frequency setting device 24.

Thereafter, the yarn is threaded onto the winding apparatus, and tension in yarn is detected by a tension detector 21 via the tension sensor 9. When the demand for threading yarn is received, the following operation is repeated and the winding operation is controlled.

More specifically, the set tension value, which has been set in the tension setting device 28, and the detected value of the tension are compared with each other in the comparator 27, and the deviation is calculated there. Then, a predetermined value, which is obtained based on the deviation, is added to or subtracted from the set speed value, which has been set in the peripheral speed setting device 29, in the calculator 26, so that the desired value of the peripheral speed, which will be used in the comparator 25, is prepared.

For example, if the detected tension is larger than the value set in the tension setting device 28, the above-described predetermined value is subtracted from the value set in the peripheral speed setting device 29. Contrary to this, if the detected tension is smaller than the value set in the tension setting device 28, the above-described predetermined value is added to the value set in the peripheral speed setting device 29, and the desired peripheral speed value is calculated.

Then, the desired value, which has been calculated in the calculator 26, and the fed-back signal from the peripheral speed detector 22 are compared with each other in the comparator 25, and the deviation is calculated there.

Based on this deviation, PI control is carried out in the controller 23, and the output frequency of the inverter 14 is controlled by the frequency setting device 24.

The above-described series of control steps is carried out by the micro computer 16 which is illustrated in FIG. 2.

Figure 4:
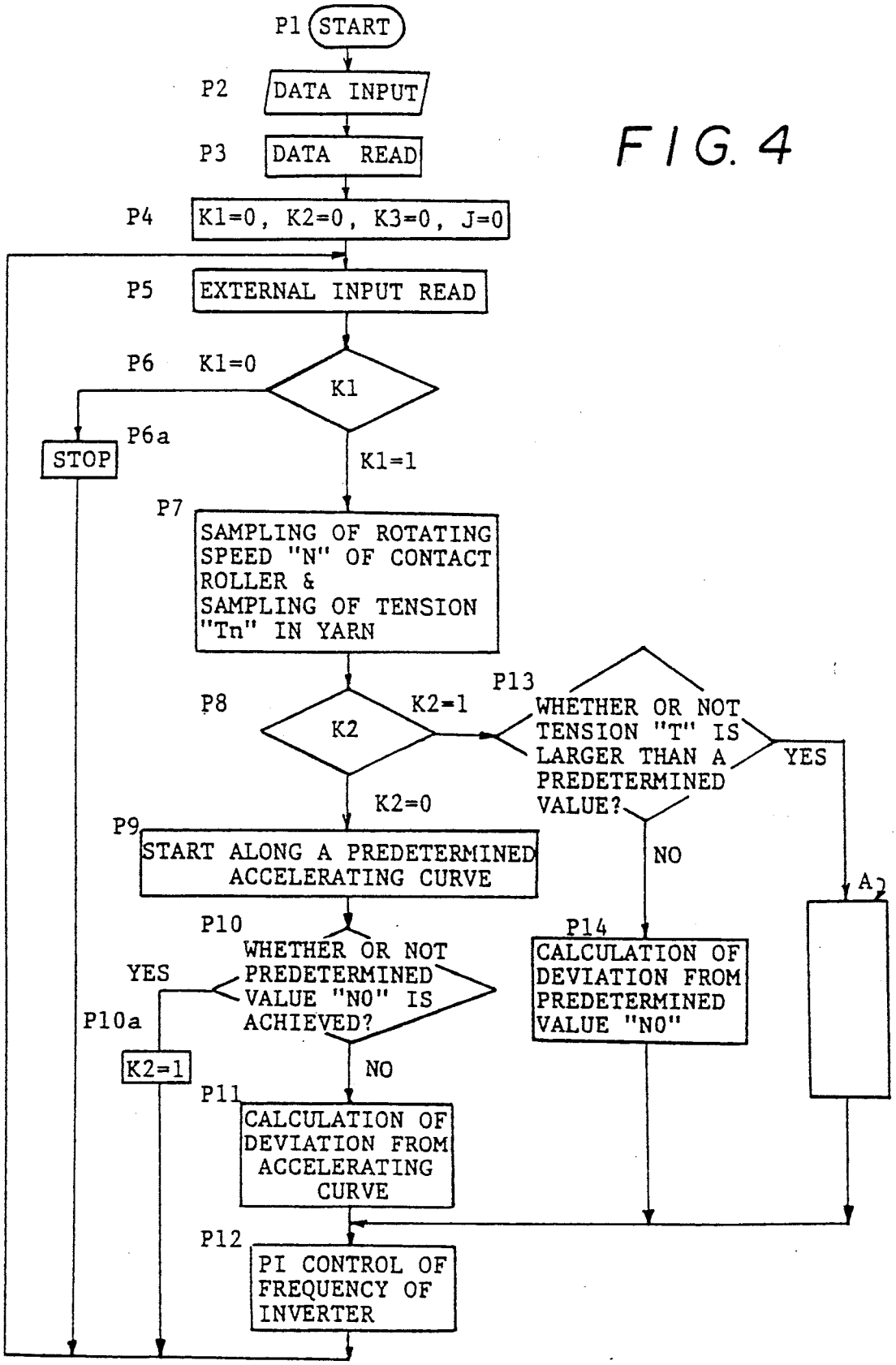
FIG. 4 is a flow chart showing an example of control of the winding apparatus of the present invention.

A flow chart example of the program for carrying out the present invention will now be explained with reference to FIGS. 4 and 5.

The program starts at step P1, and data, set rotating speed N0 of the contact roller and the set tension in yarn Y are inputted at step P2.

At step P3, data are read, and then, at step P4, memories K1, K2, K3 and J are cleared.

At step P5, the demand for starting the winding apparatus is read as an external command, i.e., $K1=1$, and since K1 is recognized as "1" at step P6, step P7 takes place.

The rotating speed N of the contact roller 7 and the tension Tn in Y yarn are sampled at step P7, and then, step P8 takes place. At this time, N and Tn are still zero.

At step P8, since K2 is "0", step P9 takes place, and the motor 13, which drives the bobbin holder 2, is driven along a predetermined accelerating curve until the rotating speed of the contact roller 7 reaches a predetermined speed N0, which has been set in the peripheral speed setting device 29.

The rotating speed N of the contact roller 7 is checked at step P10. When the rotating speed N has not reached the set value N0, the deviation is calculated at step P11, and PI control is carried out at step P12 so that the output frequency of the inverter 14 is controlled.

Thereafter, step P5 takes place, and the above-described operations are repeated, and when it is recognized that the rotating speed of the contact roller 7 reaches the predetermined value No at step P10, step **P10*a*** takes place.

At step **P10*a*, K2 is set to "1", and steps P5 and P6** take place.

At step P6, if K1 is "1", the rotating speed N of the contact roller 7 and the tension Tn are sampled, and step P8 takes place. At step P8, since K2 is "1", step P13 takes place.

If the yarn has not been threaded, the tension Tn will not have reached the predetermined value, and step P14 takes place after step P13.

At step P14, the deviation between the sampled value N and the desired value N0 is calculated. Then, PI control is carried out at step P12 so that the output frequency of the inverter 14 is controlled, and then step P5 takes place.

The signal informing the completion of threading operation is read as an external signal at step P5, and then, steps P6 and P7 take place.

The rotating speed N of the contact roller, and the tension Tn in yarn Y are sampled at step P7, and step P8 takes place.

At step P8, since K2 is "1", step P13 takes place.

Since the yarn has been already threaded, the tension Tn is detected to be more than the predetermined value at step P13, thus step P15 takes place.

Figure 5:
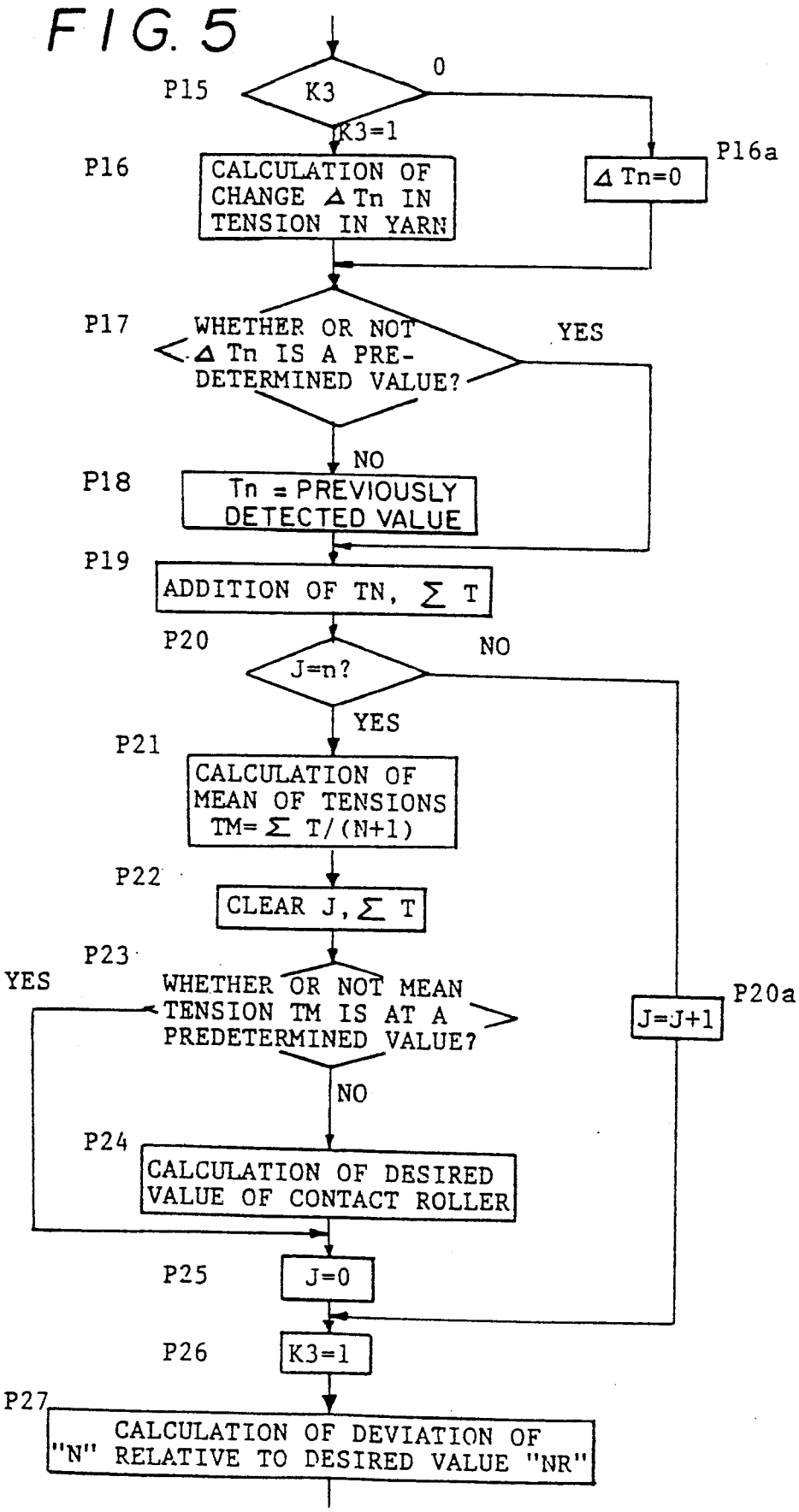
FIG. 5 is a flow chart showing the details of portion A in FIG. 4.

Referring to FIG. 5, since K3 is "0" at step P15, ΔTn, i.e., deviation of tension in yarn, is set to 0, and step P17 takes place.

Since ΔTn is "0" at step P17, it is recognized to be in a predetermined allowable range, and step P19 takes place.

At step P19, the tension Tn, which has been sampled, is added to the previous tension, and then, step P20 takes place, and since J is "0", step **P20*a*** takes place.

At step **P20*a*, after J is incremented by 1 step P26 takes place where K3** is set to 1.

At step P27, the deviation, i.e., ΔN, of the rotating speed N relative to the desired value NR is calculated, and then step P12 takes place.

Referring again to FIG. 2, at step P12, PI control is carried out based on the deviation, i.e., ΔN, so that the output frequency of the inverter 14 is controlled.

Then step P5 takes place, and the operations are performed in the foregoing manner to step P15.

Referring to FIG. 5, since K3 is "1" at step P15, step P16 takes place, where the difference, i.e., ΔTn, between the previous Tn and the present Tn is calculated, and then, step P17 takes place.

At step P17, when ΔTn is within a predetermined allowable range, step P19 takes place where the value Tn is added, and then, step P20 takes place. If the ΔTn is outside a predetermined allowable range, i.e., it is larger than the predetermined allowable range, step P18 takes place. The large delta Tn means that a sudden change of tension in yarn has occured due to, for example, hunting. In the case, this detected value is neglected, and the previous value Tn is still used as the present value Tn. This is because, if such a sudden change is included, the desired value is suddenly changed, the control system becomes unstable. After Tn is added at step P19, step P20 takes place.

At step P20, if J is not equal to J is incremented at step P20*a* and, step P26 takes place, and the above-described operations are repeated.

Contrary to this, if J is equal to "n" at step P20, step P21 takes place, where sigma T, which is obtained by adding the values of Tn, is divided by (n+1) to obtain the mean value TM of the tension, and then, J and sigma T are cleared at step P22.

Thereafter, it is checked at step P23 whether or not the mean value TM of the tension is within a predetermined range from a predetermined value T0. If the mean value TM is within a predetermined range, J is set to "0" at step 25, and K3 is set to "1" at P26, thereafter step P27 takes place.

If the mean value TM of the tension is not within a predetermined range from the predetermined value T0 at step P23, step P24 takes place to calculate the desired value NR of the speed of contact roller 7, and then J is set to "0" at step P25, thereafter step P26 takes place. At step P26, K3, which has been previously set to "1", is again set to "1", and step P27 takes place. The foregoing operations are repeated and control is carried out.

In this embodiment, the value "n" is so selected that the time for detecting the rotation of the contact roller 7 and operating the inverter 14 is shorter than the time for altering the desired value NR of the contact roller 7 based on the tension in yarn, and usually the time for detecting the rotation of the contact roller 7 and operating the inverter 14 is between several times to several hundred times as short as the time for altering the desired value NR of the contact roller 7. As a result, hunting caused by the fluctuation of the desired value of the contact roller 7 is prevented from occurring.

If the stop signal is read from the exterior at step P5, step P6*a* takes place where the winding apparatus is stopped. Then, the winding apparatus waits for the start command at step P5.

The above explanation is done with reference to a manually operated winding apparatus, however, the present invention is also applicable to a winding apparatus of an automatic changing type which has a plurality of bobbin holders and wherein the winding of the yarn is successively altered between the bobbin holders.

Further, in the above-described embodiment, a package is formed on a bobbin holder, and the winding apparatus may simultaneously form a plurality of packages on a single bobbin holder. In this case, tension in yarn may be detected for one package among a plurality of packages, or tension in a plurality of yarns may be detected. It is preferred that mean value of the detected tensions is calculated when tensions of a plurality of yarns are detected.

In addition, the desired rotational speed value of the contact roller is continuously calculated in the calculating circuit 26 after the program is started. However, depending on the system which is applied, the desired value may be cleared at every threading operation, and just after the threading operation, the value set in the peripheral speed setting device may be used.

For example, in a system wherein the tension in yarn which is being wound is varied for a long time, the former system is preferred, i.e., the value calculated in the calculating circuit may be used as the desired value. Contrary to this, when the tension in yarn is altered from the start of the package winding operation to the completion of the winding operation in order to minimize high shoulders, the latter system is preferred. i.e., the desired value may be cleared at every threading operation, and just after the threading operation, the value set in the peripheral speed setting device may be used.

Figure 6:
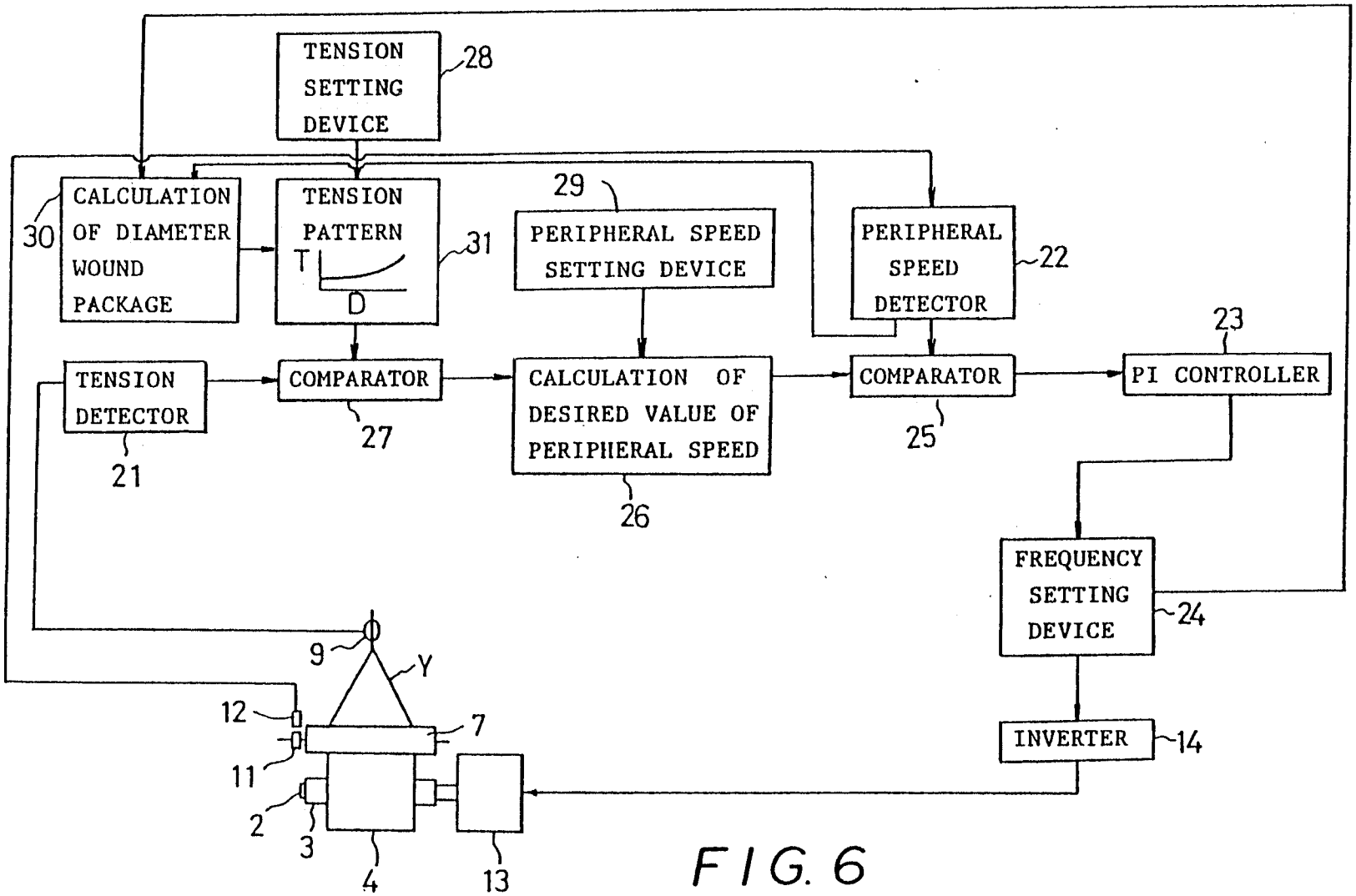
FIG. 6 is a block diagram of another embodiment of the present invention.

FIG. 6 is a block diagram of another embodiment, wherein the tension in yarn which is being wound is controlled so that it is altered along a predetermined pattern. The constructions which are different from those described with reference to the above-described embodiment will be explained.

Reference numeral 31 denotes a circuit for storing the tension pattern, and the pattern is inputted to the circuit 31 from the tension setting device 28. Reference numeral 30 denotes an arithmetic circuit which calculates the diameter of the wound package from the output of the frequency setting device 24 and the peripheral speed detector 22, and which determines the tension value outputted by the tension pattern memorizing circuit 31 to comparison and arithmetic circuit 27 based on the calculated diameter inputted thereto.

The embodiment of the yarn winding apparatus of a spindle drive type has been explained above, and an embodiment of a yarn winding apparatus of a friction drive type will now be explained. The same constructions as those in the above-described yarn winding apparatus of a spindle drive type are omitted, and only the constructions different from those of the yarn winding apparatus of a spindle drive type will be explained.

Figure 7:
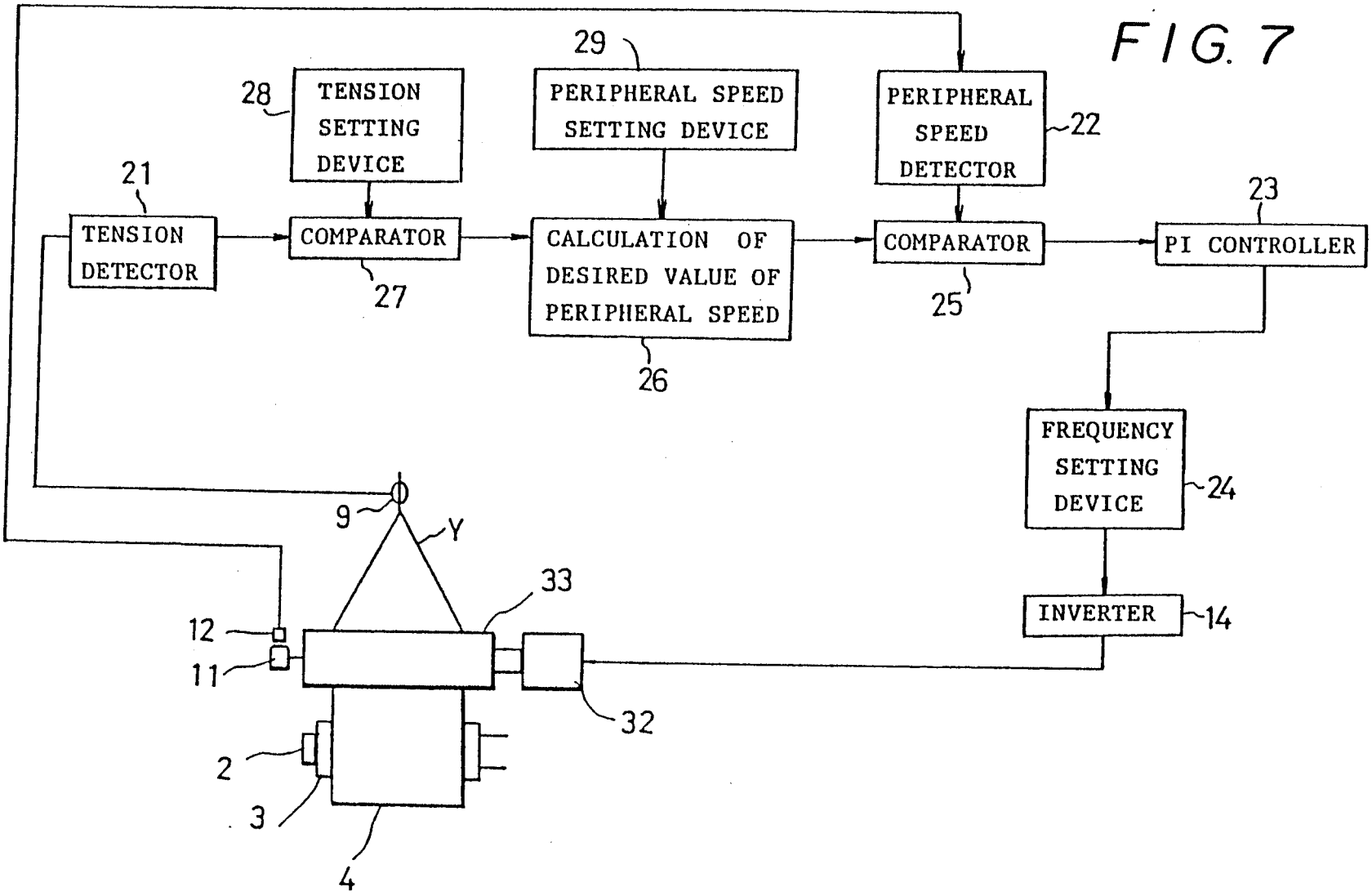
FIGS. 7 and 8 are block diagrams of winding apparatuses of a friction drive type according to the present invention.

In FIG. 7, a friction roller 33 is connected to a drive motor 32 and is driven by the drive motor 32. The bobbin 3 is inserted onto the bobbin holder 2, and the friction roller 33 is pressed against the bobbin 3 or the package 4 formed on the bobbin 3 so as to frictionally rotate the bobbin holder 2 and wind the yarn onto the bobbin.

Similar to the contact roller 7 of the above-described embodiment, an end of the friction roller 33 has a gear 11 fixed thereto, and the rotating speed of the friction roller 33 is detected by the pickup 12.

The rotating speed of the friction roller 33 which is detected by the pickup 12 is controlled in a manner similar to those illustrated in FIGS. 3 and 6, and the output of the inverter 14, which is connected to the drive motor 32, is PI controlled. In this case, in the above explanation with reference to FIGS. 3 and 6, the contact roller 7 should be read as the friction roller 33, and the motor 13 for driving the spindle should be read as the motor 32 for driving the friction roller.

Figure 8:
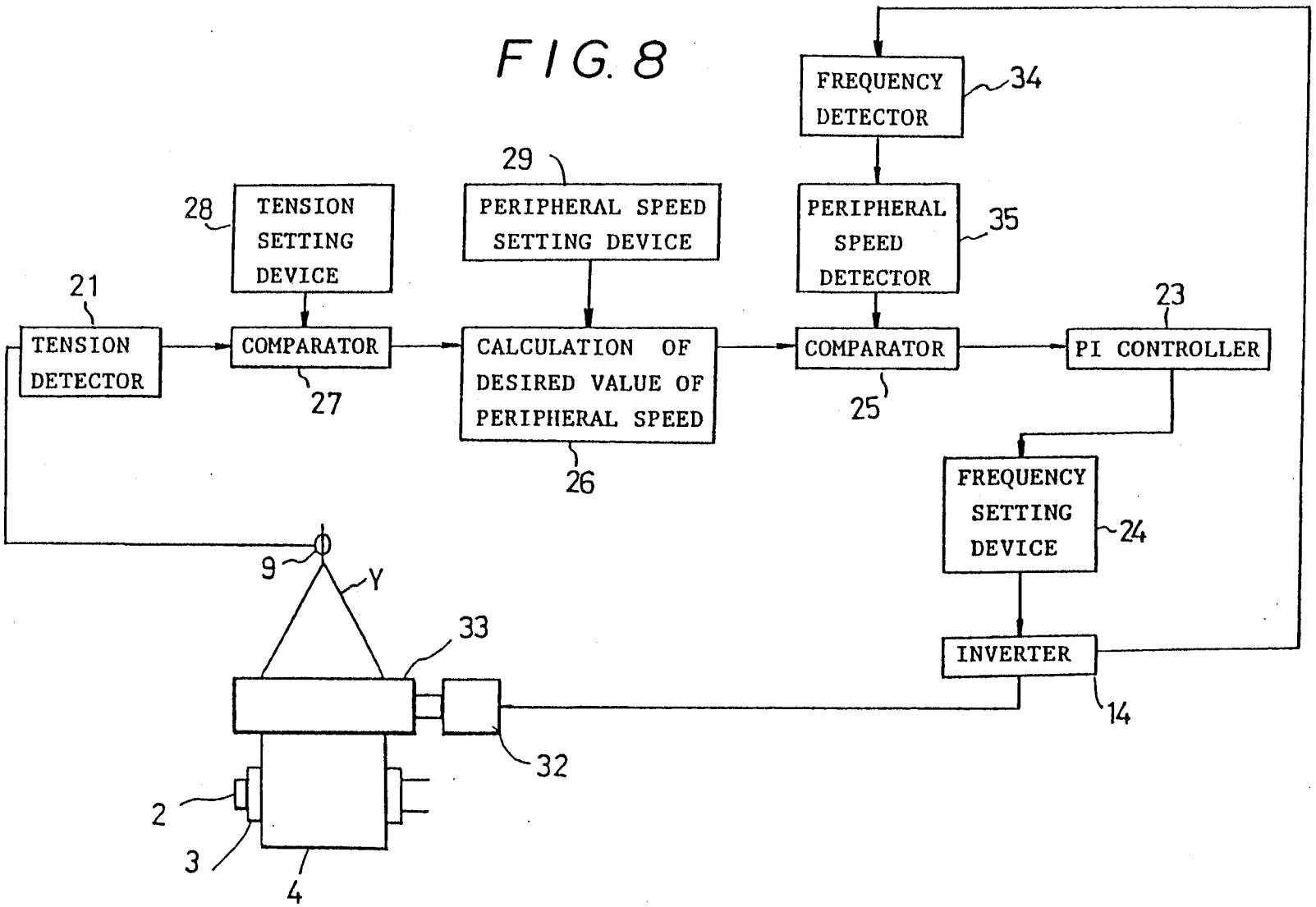

In the embodiment illustrated in FIG. 8, a synchronous motor 32 is used as a motor for driving, the friction roller 33, and the frequency of the inverter 14 is counted by frequency detector 34 in order to calculate the peripheral speed relative to the counted frequency in the arithmetic circuit 35 for the peripheral speed in place of detection of the rotating speed of the friction roller 33 by the pickup 12. The thus calculated peripheral speed is compared with the desired value of the peripheral speed. In place of the detection of the frequency of the inverter 14, the value in the frequency setting device may be used. Other constructions are substantially the same as those in the embodiment illustrated in FIG. 7.

According to the method of the present invention, rotation of a motor for driving the bobbin holder is controlled based on information comprising data detected by the rotating speed detector and data detected by the tension detector so that the winding speed is adjusted at to predetermined value, accordingly, a stable winding operation can be performed by controlling a winding apparatus simultaneously utilizing the advantages of both the conventional systems of the peripheral speed control type and the tension control type.

Further, according to the winding apparatus of the present invention, the rotation of the motor which directly or indirectly drives the bobbin holder is controlled so that the rotating speed of the contact roller which is pressed against the package converges to a predetermined and desired value, and at the same time, the tension in yarn which is being wound is detected and the desired value of the rotating speed of the contact roller is varied so that tension is controlled to a predetermined value. Accordingly, a sudden change of speed can be overcome in a short time by the control of rotation of motor, and a tension variation as a function of time or due to increase of wound package can be overcome by varying the desired value of the rotating speed of the contact roller. Therefore, stable winding operation with high control accuracy can be realized.

In addition, in a high speed winding operation, tension in yarn which varies at a short period under the influence of the traverse motion may be detected so as to feed back to the winding operation.

Therefore, according to the present invention, winding of a low retraction yarn, which has been conventionally unable to be stably wound, can be carried out, and the productivity can be enhanced.

What we claim is:

1. A method for winding a yarn in a yarn winding apparatus having a bobbin holder for holding a yarn winding bobbin on which a yarn package is wound by rotating said bobbin holder, an a contact roller pressed against either of said bobbin and said package for continuously winding said yarn onto said bobbin, comprising the steps of:

detecting a rotational speed of said contact roller;

detecting an amount of tension in said yarn; and controlling the rotational speed of said bobbin holder during winding of said yarn thereon as a function of both said detected rotational speed and said detected amount of tension so as to wind said yarn on said bobbin holder at a variable rotational speed.

2. An apparatus for winding a yarn onto a bobbin to form a yarn package, comprising:

a bobbin holder for holding said bobbin;

a means for rotating said bobbin holder;

a contact roller pressed against either of said bobbin and said package for continuously winding said yarn onto said bobbin;

speed detecting means for detecting a rotational speed of said contact roller;

tension detecting means for detecting an amount of tension in said yarn; and controller means for controlling the rotational speed of said bobbin holder during winding of said yarn thereon as a function of both said detected rotational speed and said detected amount of tension so as to wind said yarn on said bobbin holder at a variable rotational speed.

3. An apparatus for winding a yarn according to claim 2, wherein said means for rotating comprises a motor for driving said bobbin holder;

said controller means controlling the rotation of said motor according to a desired speed value which is varied by said detected rotational speed and said detected amount of tension.

4. An apparatus for winding a yarn according to claim 2, wherein said means for rotating further comprises a motor for driving said contact roller;

said controller means controlling the rotation of said motor according to a desired speed value which is varied by said detected rotational speed and said detected amount of tension.

5. An apparatus for winding a yarn according to claim 2 or claim 4 wherein said tension in yarn and said rotating speed of said contact roller are sampled, and a time interval for varying said desired value based on said sampled tension in said yarn is longer than a time interval for controlling said rotation of said motor based on said sampled rotating speed of said contact roller.

6. An apparatus for winding a yarn according to claim 3 or claim 4, wherein said motor is an induction motor, and said speed detecting means comprises a magnetic pick-up element mounted proximate a toothed gear coupled to said contact roller.

7. An apparatus for winding a yarn according to claim 3 or claim 4, wherein said motor is a synchronous motor, and said speed detecting means comprises a frequency detector for detecting a frequency of a driving signal applied to said motor.

* * * * *

UNITED STATES PATENT AND TRADEMARK OFFICE

CERTIFICATE OF CORRECTION

PATENT NO. : 5,141,169

DATED : August 25, 1992

INVENTOR(S) : Takami Sugioka

It is certified that error appears in the above-identified patent and that said Letters Patent is hereby corrected as shown below:

Col. 1, line 20 "49-20452" should be --49-20453--.

Col. 1, line 31 "these" (second occurrence) should be --there--.

Col. 3, line 22 "operation" should be --operation,--.

Col. 3, line 23 "sient," should be --sient--.

Col. 4, line 14 "9" should be --9;--.

Col. 4, line 35 after "optimum" insert --desired--; after "the" delete "desired".

Col. 6, line 67 "delta" should be --Δ--.

Col. 7, line 1 "the" should be --this-- and "this" should be --the--.

Col. 7, line 5, after "changed," insert --and--.

Col. 7, line 7 after "to" insert --"n",--.

Col. 7, line 8 "and," should be --and--.

UNITED STATES PATENT AND TRADEMARK OFFICE

CERTIFICATE OF CORRECTION

PATENT NO. : 5,141,169

DATED : August 25, 1992

INVENTOR(S) : Takami Sugioka

It is certified that error appears in the above-identified patent and that said Letters Patent is hereby corrected as shown below:

Col. 7, line 44 delete "done".

Col. 9, line 39 "an" should be --and--.

Col. 10, line 33 "2" should be --3--.

Signed and Sealed this

Twenty-third Day of November, 1993

*Attest:*

Bruce Lehman

BRUCE LEHMAN

*Attesting Officer*

*Commissioner of Patents and Trademarks*